US007386906B2

(12) United States Patent
Roth et al.

(10) Patent No.: US 7,386,906 B2
(45) Date of Patent: Jun. 17, 2008

(54) OSCILLATING BRUSHHEAD ATTACHMENT SYSTEM FOR A PERSONAL CARE APPLIANCE

(75) Inventors: Dane M. Roth, Seattle, WA (US); Stephen M. Meginniss, III, Seattle, WA (US); Kenneth A. Pilcher, Seattle, WA (US); Richard A. Reishus, Renton, WA (US); David Giuliani, Mercer Island, WA (US)

(73) Assignee: Pacific Bioscience Laboratories, Inc., Bellevue, WA (US)

( * ) Notice: Subject to any disclaimer, the term of this patent is extended or adjusted under 35 U.S.C. 154(b) by 176 days.

(21) Appl. No.: 10/873,352

(22) Filed: Jun. 22, 2004

(65) Prior Publication Data

US 2005/0278876 A1 Dec. 22, 2005

(51) Int. Cl.
*A46B 13/02* (2006.01)

(52) U.S. Cl. ..... 15/28; 15/22.1; 15/21.1; 15/97.1

(58) Field of Classification Search ..... 15/28, 15/22.1, 21.1, 97.1; 601/114, 142
See application file for complete search history.

(56) References Cited

U.S. PATENT DOCUMENTS 4,158,246 A 6/1979 Meadows et al.
4,203,431 A * 5/1980 Abura et al. ..... 601/6
4,670,931 A * 6/1987 Abbassi ..... 15/167.1
5,687,442 A * 11/1997 McLain ..... 15/29
5,697,115 A 12/1997 Sciarra et al.
5,891,063 A 4/1999 Vigil
6,021,538 A * 2/2000 Kressner et al. ..... 15/28
6,253,405 B1 7/2001 Gutelius et al.
6,564,940 B2 * 5/2003 Blaustein et al. ..... 206/362.2
6,575,924 B2 6/2003 Wevers et al.
6,748,619 B2 * 6/2004 Quach ..... 15/29
2005/0199265 A1 * 9/2005 France et al. ..... 134/6

* cited by examiner

*Primary Examiner*—Shay L Karls
(74) *Attorney, Agent, or Firm*—Clark A. Puntigam; Jensen & Puntigam, P.S.

(57) ABSTRACT

The brushhead attachment system includes a hub member which is secured to a drive shaft of a personal care appliance for oscillating action. The hub member includes a number of spaced locking elements in the form of protrusions around the periphery thereof. An annular outer brushhead portion with a first group of bristles includes a plurality of spaced grooves in the outer surface thereof which mate with extending pins in the body of the appliance for insertion and removal of the outer brushhead portion. An inner brushhead portion is configured to fit within the annular opening of the outer brushhead portion and includes a plurality of depending legs which mate with the protrusions on the drive member for resulting oscillating action of the inner brushhead portion when the drive member oscillates, at least some of the legs having latch elements which fit onto an interior lip of the outer brushhead portion in such a manner that the inner and outer brushhead portions may be installed and removed as a unit, while permitting the inner brushhead portion to be freely rotatable relative to the outer brushhead portion.

15 Claims, 3 Drawing Sheets

OSCILLATING BRUSHHEAD ATTACHMENT SYSTEM FOR A PERSONAL CARE APPLIANCE

TECHNICAL FIELD

This invention relates generally to large brushhead structures for a personal care appliance, such as a skin cleaning apparatus, and more specifically relates to an attachment system for such a brushhead to a driving member in the appliance.

BACKGROUND OF THE INVENTION

In personal care appliances, including those having a relatively large brushhead assembly, such as those used for cleaning skin, the brushhead must be readily removable and installable by a user, because of regular replacement requirements, and when installed, must have a solid, positive connection with a drive member for the appliance, such as a rotating shaft, with no or little loss of motion between the drive member and the brushhead. With conventional brushheads, these objectives are accomplished with a variety of attaching structures, including screw-on connections, or snap connections which have tabs to mate with matching openings in the body of the appliance.

However, with complicated brushhead designs, reliable and convenient attachment becomes more problematic. For instance, in a brushhead having two or more parts, with each operating differently, such as different motions, there is difficulty in maintaining the two parts in the required relationship to produce the different actions, while also permitting installation of the complete brushhead into the appliance body with a convenient, single easy action. In the embodiment disclosed herein, one portion of the brushhead is movable in operation of the appliance, while the other portion remains stationary. In this particular arrangement, the movable part must engage the drive member, while the other part is positioned and held such that it does not move with the drive member, yet the two separate parts must be removable and installable as a single unit.

SUMMARY OF THE INVENTION

Accordingly, the present invention is a brushhead assembly attachment system for a personal care appliance, comprising: a hub member adapted to be secured to a driven shaft of a personal care appliance, the hub member including a plurality of locking elements around the periphery thereof; an outer brushhead portion having a first cleaning member extending therefrom, the outer brush assembly having a connecting structure for removably joining the outer brushhead assembly to the personal care appliance; and an inner brushhead portion having a second cleaning member extending therefrom, configured to fit with the outer brushhead assembly, wherein the inner brushhead assembly includes depending legs, at least some of which mate with the locking elements on the hub member, such that oscillating movement of the hub member results in similar movement of the inner brushhead member, wherein at least some of the depending legs are configured to removably latch onto a portion of the outer brushhead portion, providing a joining relationship therebetween, wherein the inner brushhead portion and the outer brushhead portion are configured relative to each other and to the hub member such that attaching the outer brushhead portion to the appliance body by means of said connecting structure results in both connection of the outer brushhead portion to the appliance body and connection of the inner brushhead portion to the hub member.

BEST MODE FOR CARRYING OUT THE INVENTION

Figure 1:
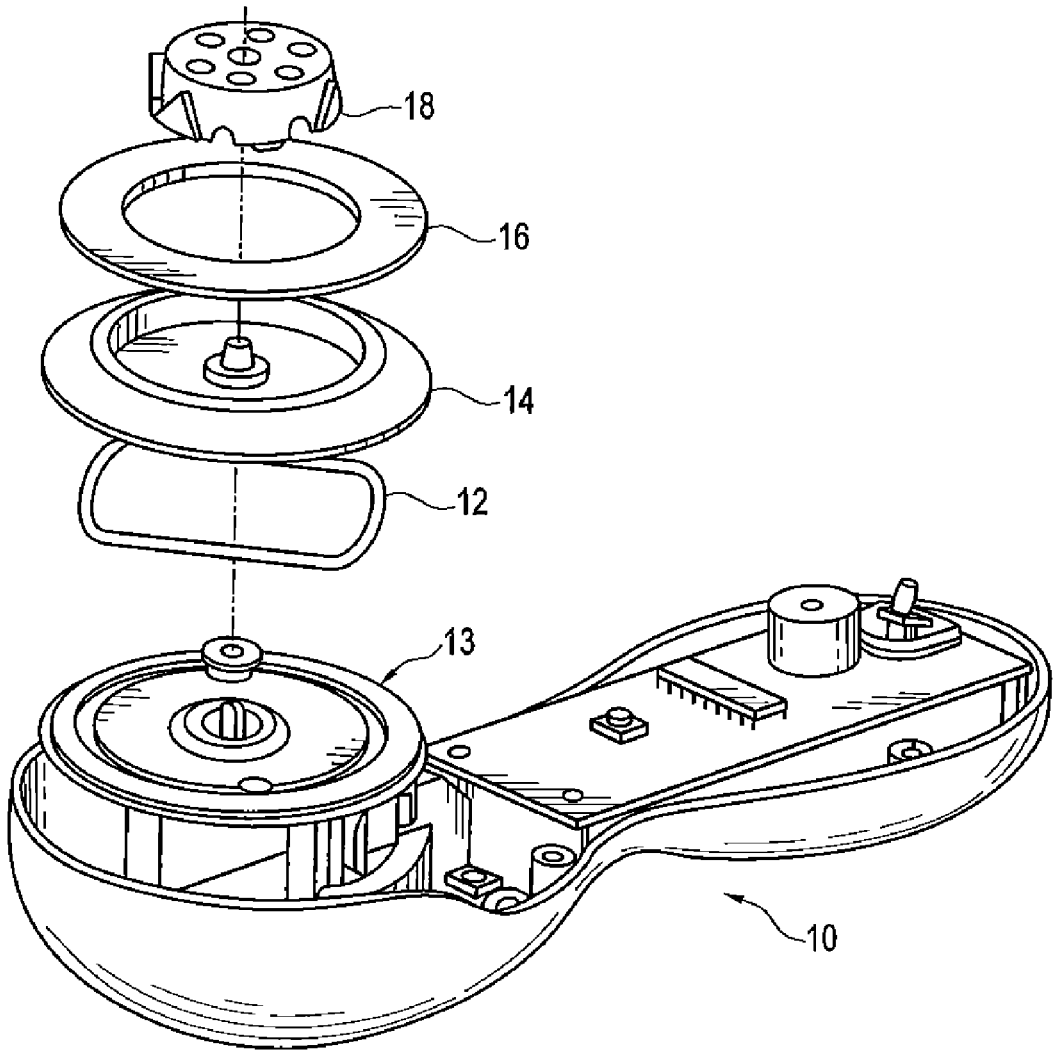
FIG. 1 is a partially exploded view of a personal care appliance with which the brushhead attachment system of the present invention can be used.
Figure 2:
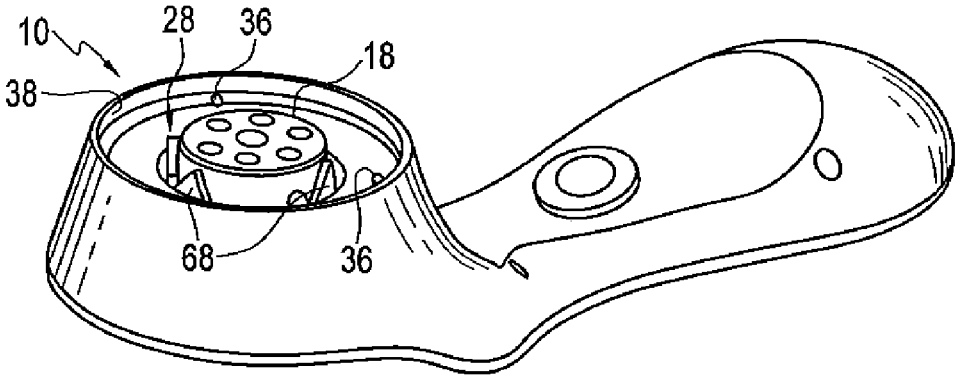
FIG. 2 shows the appliance of FIG. 1, ready to receive a brushhead assembly.

FIGS. 1 and 2 show a personal care appliance 10 which is described in more detail in co-pending application titled "Motor Providing Oscillating Action for a Personal Care Appliance" and "Brush Configuration for a Powered Skin Cleansing Brush Appliance", both owned by the assignee of the present invention, the contents of which are hereby incorporated by reference. As shown, personal care appliance 10 is for skin cleaning applications, particularly facial skin. However, appliance 10, as well as the brushhead attachment mechanism shown and described herein, can be used in a variety of other applications, including other skin care applications, such as acne and blackhead treatment; athlete's foot treatment; calloused skin and psoriasis treatment; treatment of razor bumps and related skin applications, such as wound cleansing and treatment of slow or non-healing wounds; scalp cleansing and chemical peel procedures, and shaving cream applicators.

The personal care appliance 10 includes an oscillating motor structure in the body thereof which drives an armature through a total angle of 8°-26°, at a frequency in the range of 120-220 Hz. This angle can be varied, however, depending upon the particular application. The personal care appliance 10 includes a wave washer 12 above a motor bracket 13, the washer 12 providing a spring action directed upwardly in FIG. 1. Positioned on top of wave washer 12 is a seal 14 which protects wave washer 12. An interference washer 16 provides a low friction interface between seal 14 and the brushhead assembly, as discussed in detail below. A driving hub 18 is attached (locked) to the top end of the armature drive member in the appliance and oscillates therewith. Drive hub 18 is particularly configured for use with the brushhead assembly and is part of the overall attachment system for the brushhead assembly to the appliance.

Figure 3:
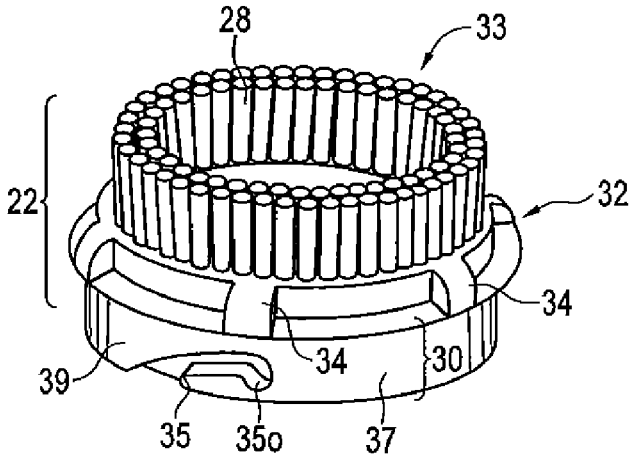
FIG. 3 is a schematic view of an outer stationary portion of the brushhead assembly system described herein.
Figure 7:
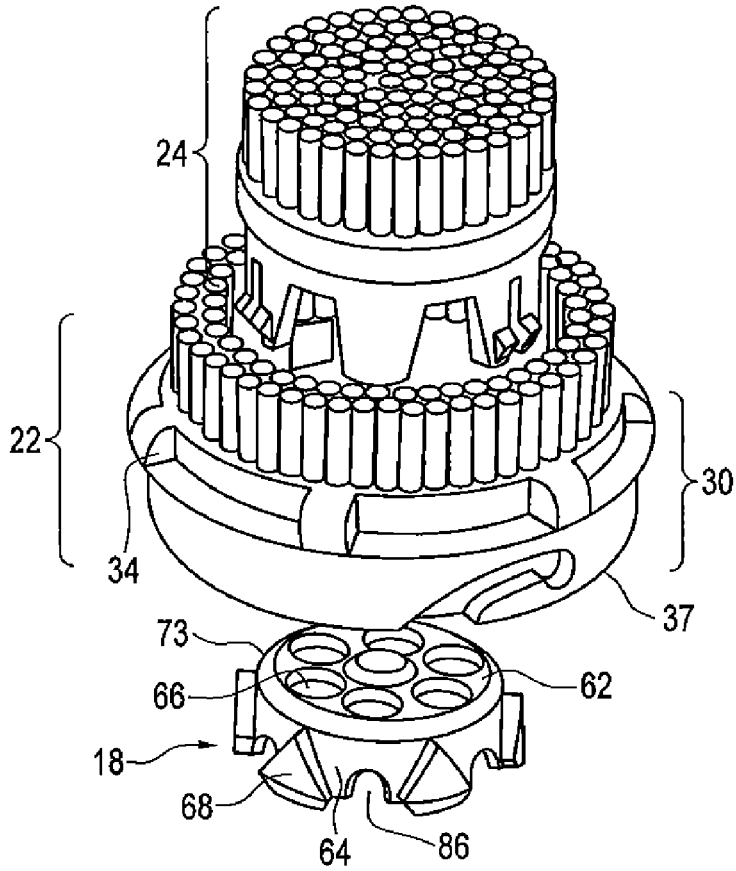
FIG. 7 is an exploded view showing the relationship of the inner and outer portions of the brushhead assembly and the driving hub portion of the appliance.

Referring now to FIGS. 3 and 7, the brushhead attachment mechanism includes three portions, drive hub 18, an outer brushhead portion 22, which remains stationary during operation of the appliance, and an inner brushhead portion 24 which oscillates through a selected angle during operation of the appliance. The inner brushhead portion 24 has an operative relationship with drive hub 18 such that as drive hub 18 oscillates through a selected angle, so does inner brushhead portion 24.

In the embodiment shown, outer brushhead portion 22 is annular, with an outside diameter of approximately 1.975 inches, with a central opening 28. Outer brushhead portion 22 includes a base portion 30 with a rim 32 around the top periphery thereof which includes a plurality of spaced finger grips 34, which helps the user in the installation and removal of the brushhead assembly.

Extending upwardly from base portion 30 are outer brushhead bristles 33, which in the embodiment shown, are two concentric, adjacent, complete bristle tuft rings. The outer ring of bristles has a diameter of approximately 1.53 inches, while the diameter of the inner ring of bristles is approximately 1.39 inches. The arrangement of the bristles is circular, which is preferred, although not necessary.

Arranged in the exterior surface of the outer brushhead portion are three pin grooves 35, separated by 120°. Matching pins 36 on inner surface 38 of a boundary wall defining the opening for the brushhead assembly provide the desired mating relationship between outer brushhead portion 22 and the appliance body 10. Pin grooves 35 shown in FIG. 3 are configured to permit the outer brushhead portion 22 to be positioned within the opening in the appliance body 10 such that pins 36 on inner surface 38 are at the entry point of pin grooves 35. Pin grooves 35 extend at a small upward angle (toward the bristles) in the exterior surface 39 of the outer brushhead portion 22 as they also extend peripherally, approximately 1.1 inches.

At the end of each pin groove 35 is a small portion 35*a* which angles downwardly toward lower edge 37 of base 30 of the outer brushhead portion 22. This arrangement provides an "over-travel" capability for outer brushhead portion 22 as it is moved onto the appliance body 10, and assists in obtaining a secure, solid physical relationship between the inner brushhead portion 24 and the drive hub 18, as explained in more detail below.

Figure 4:
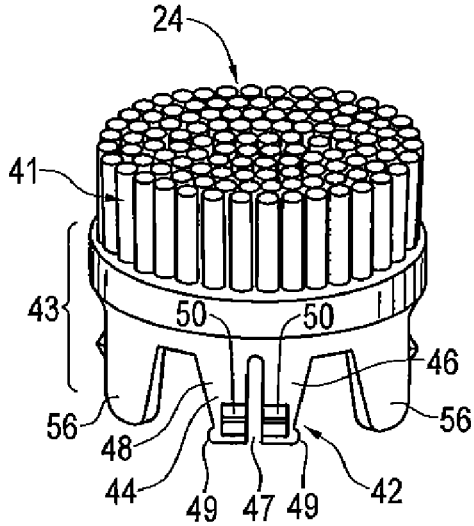
FIG. 4 is a schematic view of an inner movable portion of the brushhead assembly described herein.

Inner brushhead portion 24 is shown in more detail in FIG. 4. It has a generally circular configuration and is arranged to fit into the central opening 28 of outer brushhead portion 22. There could be a gap (space) between the bristles and the inner and outer brushhead portions, in the range of 0.050-0.125 inches, preferably 0.084 inches. Inner brushhead portion 24 includes a plurality of inner brushhead bristles 41 which extend upwardly from a base portion 43, with the bristles 41 arranged in a circular pattern covering the entire upper surface of base portion 43. The inner brushhead portion 24 in the embodiment shown includes two sets of depending legs on the outer periphery thereof. The first set of three legs 42-42, spaced at 120° intervals, each leg comprising a pair of snap portions 44 and 46, defined by a slot 47 which extends down the middle of each snap leg 42.

The two snap portions of each snap leg are configured and arranged to slightly flex toward each other during installation of the inner brushhead portion 24 on the driving hub 18, with the outside edges of the free tips of the snap portions 44, 46 having outward bulges 49-49 which snap back (with the snap portions) after they pass over a pointed portion of the drive hub 10, as explained in more detail below, helping to tightly engage the drive hub 18 and retain the inner brushhead portion 24 on drive hub 18.

Figure 6:
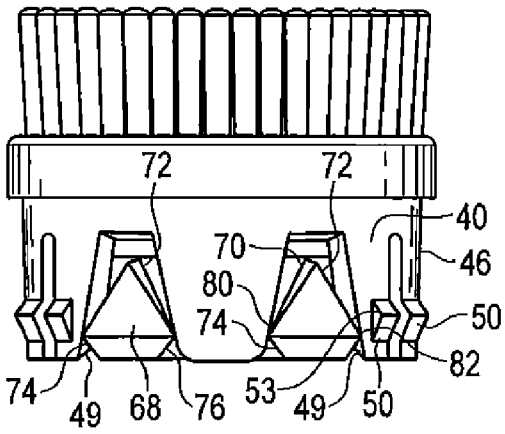
FIG. 6 shows the connection between the inner portion of the brushhead assembly and a driving hub of the appliance.

Extending outwardly from outer surface 48 of each snap portion is locking snap elements 50. Locking snap elements, as shown in more detail in FIG. 6, are triangular-shaped elements, which include a slightly V-shaped upper surface 53 thereof, assisting in aligning and latching the inner brushhead portion 24 to the outer brushhead portion 22, as described in more detail below.

The inner brushhead portion 24 further includes a second trio of spaced drive legs 56-56. Drive legs 56 alternate with snap legs 42 around the periphery of inner brushhead portion 24 and are also separated by 120° intervals. Drive legs 56 taper slightly from their base to their free ends, which are rounded, designed to provide a close tolerance fit between them and the drive hub.

Figure 5:
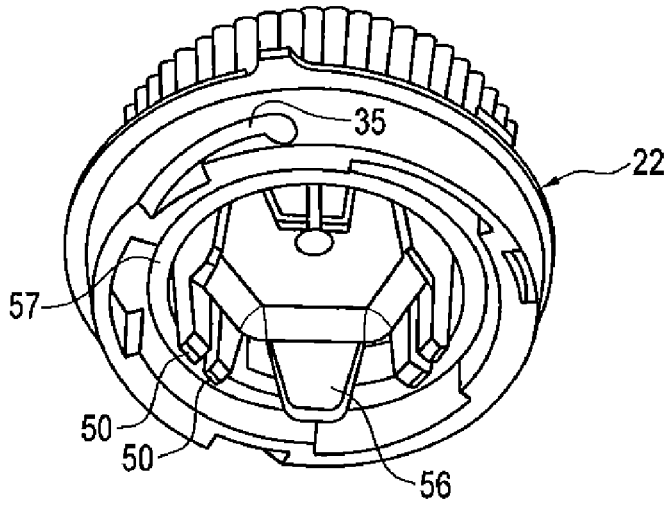
FIG. 5 shows the connection between the inner and outer brushhead portions of FIGS. 3 and 4.

FIG. 5 shows the attachment arrangement between inner brushhead portion 24 and outer brushhead portion 22. Snap legs 42 and drive legs 56 of the inner brushhead portion 24 are moved down into annular opening 28 of the outer brushhead portion, with snap legs 42 being moved slightly inwardly in the process. When inner brushhead portion 24 is moved into the outer brushhead portion a sufficient distance, the locking snap elements 50 on each of the snap portions 44 and 46 clear a circular lip 57 on the internal surface of the outer brushhead portion 22 and then rebound slightly outwardly, underneath leg 57. This action joins the two brushhead portions together. The inner brushhead portion 24 may be separated from the outer brushhead portion 22 by forcing the snap portions 44, 46 inwardly until they clear lip 57, at which point the inner brushhead portion 24 is separated from the outer brushhead portion 22 and can be lifted clear of the outer brushhead portion 22.

When the two brushhead portions are joined together, as described above, the inner brushhead portion 24 cannot fall off/away from the outer brushhead portion 22, but is free to rotate relative to the outer brushhead portion 22. This is an important structural feature of the brushhead attachment arrangement disclosed herein.

FIGS. 6 and 7 shows the physical connection between the inner brushhead portion, in particular, snap legs 42-42 and drive legs 56-56 and drive hub 18. Drive hub 18, as previously indicated, is generally circular in configuration, with an upper surface 62, a depending circular wall 64 and a series of diamond-shaped projections 66 on the wall at spaced intervals, separated by clearance space into which the snap legs 42 and drive legs 56 can fit. In the embodiment shown, drive hub 18 includes a number of openings 68 in the upper surface 62 thereof, to facilitate cleaning and draining of the bristles in the outer and inner brushhead portions. Circular wall 64 is tapered slightly outwardly from top to bottom to produce a splaying effect on all the legs of the inner brushhead portion 24, to assure a snug fit between the inner brushhead portion 24 and the drive hub 18.

The diamond-shaped projections 68 on the wall 64 each include two angled upper edge surfaces 70, 72 which come to a point at the top edge 73 of wall 64. At the lower end of edge surfaces 70 and 72 are lower edge surfaces 74 and 76 which angle inwardly toward each other over a short distance to lower edge 78 of drive hub 18. The diamond-shaped projections 68 thus have two maximum width points 80 and 82 which define the maximum width of the projections, located a short distance above the lower edge of the drive hub 18.

Further, semi-circular openings 86 are defined in wall 64, between successive projections 68 around the periphery of the hub to aid in cleaning and drying.

The configuration of the projections 68 in association with the configuration of the two sets of depending legs 42, 56 on the inner brushhead portion 24 provide a reliable and secure attachment between drive hub 18 and the inner brushhead portion 24, such that there is little or no lost motion between drive hub action and the inner brushhead action.

The two sets of legs 42, 56 perform distinctly different functions as described herein, with the snap legs 42 primarily latching the two brushhead portions together and the drive legs 56 transferring the rotational energy of the hub to the brushhead.

Each drive leg 56 contacts the maximum width points 80, 82 of two adjacent projections on the drive hub, providing efficient transfer of rotational movement, with an interference fit therebetween. As indicated above, snap-legs 42 include bulge portions 49 at the tips thereof which move slightly outwardly with the snap portions 44, 46 after they pass maximum width points 80 and 82 of the projection. This arrangement also helps to provide a reliable connection between drive hub 18 and the inner brushhead portion 24.

As indicated above, outer wall 64 of drive hub 18 is tapered relative to all the depending legs of the inner brushhead portion 24, so that the legs tend to be forced outwardly as the inner brushhead portion 24 is moved downwardly onto the drive hub 18, again ensuring a snug, reliable fit between drive hub 18 and the inner brushhead portion 24. The combination of the diamond configuration of projections 68, the tapered wall 64 of the drive hub 18, and the configuration of the two sets of legs 42 and 56 of the inner brushhead portion 24 provide a reliable, tight, interference fit between the inner brushhead portion 18 and the drive hub, so that both an efficient transfer of rotational motion and secure retention of the two brushhead portions is provided.

An important aspect of the brushhead attachment system disclosed herein is the arrangement by which the brushhead assembly as a whole (the outer and inner portions) is installed into the appliance, while at the same time producing the desired structural connection between the drive hub 18 and the inner brushhead portion 24 described above when the installation is made. This is accomplished by the pin and pin groove arrangement between the appliance body 10 and the outer brushhead portion 22 and the relative position of the joined inner and outer brushhead portions 22, 24 and the drive hub 18.

The complete brushhead assembly is initially positioned in the corresponding opening in the appliance body, toward drive hub 18, which is secured to the oscillating spring drive member of the appliance. The brushhead assembly is inserted into the opening, using the finger grips 34 on the outer brushhead portion 22, positioning the outer brushhead portion so that pins 36 in the body 10 of the personal care appliance mate with the openings to the pin grooves 35 in the outer surface of the outer brushhead portion 22. Pin and pin groove alignment is straightforward. Special alignment or orientation is not required. The outer brushhead portion 22 can be arbitrarily placed inside the opening in the appliance body 10 and then rotated until the pins 36 begin to engage the grooves 35.

The outer brushhead portion is then rotated in a clockwise direction, which draws the outer brushhead portion 22 a distance inwardly, with the inner brushhead portion 24 moving along with it. As the outer brushhead portion 22 is drawn inwardly, the inner brushhead portion 24 encounters installation resistance of the hub 18. When this occurs, the V-shaped upper surfaces 53 on the locking snap elements 50 axially align the inner brushhead portion 24 with the outer brushhead portion 22 and the snap elements 50 engage lip 57-57 of the outer brushhead portion 22.

Further rotation of the outer brushhead portion causes legs 42 and 56 of the inner brushhead portion 24 to move into operative relationship with drive hub 18. The geometry of the various parts is arranged with over-travel so that prior to the outer brushhead portion reaching the end of its rotational travel defined by the pins 36 in the pin grooves 35, the inner brushhead portion 24 has been snugly fitted to the drive hub 18. At the end of the rotational travel, the outer brushhead portion 22 is released, and the wave washer 12 tends to force the outer brushhead portion 22 slightly outwardly until the pins 26 on the appliance body 10 are positioned at the very end 35*a* of the pin grooves 35. This last movement of the outer brushhead portion 22 provides the required operational clearance between the outer brushhead portion 22 and the inner brushhead portion 24.

In this position, outer brushhead portion 22 is locked in a selected rotational position relative to inner brushhead portion 24, and the upper bristle surface of the outer brushhead portion 22 is substantially coplanar with the upper bristle surface of the inner brushhead portion 24. The bristles could be arranged, however, such that the bristle surfaces are in different but still parallel planes. While the outer brushhead portion 22 is now locked in position rotationally, the inner brushhead portion 24 is free to oscillate, surrounded by the outer brushhead portion 22, driven by drive hub 18. This arrangement thus has the important advantage of having both portions of the brushhead assembly, i.e. the fixed outer portion 22 and the movable inner portion 24 installed in the appliance in one operation.

To remove the complete brushhead assembly, it is only necessary to depress the outer brushhead portion 22 against the wire spring 12 action and rotate the outer brushhead portion counterclockwise. This action reverses the installation procedure. As the brushhead is rotated, the cam action of pins 36 in the pin grooves 35 drives the complete brushhead assembly outward. With continued rotation, the outer brushhead 22 comes free of the pins 36, at which point the entire brushhead assembly can be removed, in one action, because the inner brushhead portion 24 is still joined to the outer brushhead portion 22 by the locking projections 53 on the snap legs 42 relative to the lip 57 on the interior surface of the outer brushhead portion.

Accordingly, a brushhead attachment system has been disclosed which can attach a brushhead assembly having two portions, one oscillating and one not oscillating in operation, to an appliance body with one installation action.

Although a preferred embodiment of the invention has been disclosed for purposes of illustration, it should be understood that various changes, modifications and substitutions may be incorporated in the embodiment without departing from the spirit of the invention which is defined by the claims which follow. For instance, while the cleaning member has been disclosed as bristles, it could be other arrangements, including various foam members, elastomeric members, etc.

What is claimed is:

1. A brushhead assembly attachment system for a personal care appliance which includes an appliance body, comprising:

a hub member adapted to be secured to a driven shaft of a personal care appliance, the hub member including a plurality of locking elements around the periphery thereof;

an outer brushhead portion having a first cleaning member extending therefrom, the outer brushhead portion having a connecting structure for removably joining the outer brushhead assembly to the personal care appliance; and an inner brushhead portion having a second cleaning member extending therefrom, configured to fit within the outer brushhead portion, which is configured to encircle the inner brushhead portion, wherein the inner brushhead portion includes a plurality of depending legs, at least some of which mate with the locking elements on the hub member, such that oscillating movement of the hub member results in similar movement of the inner brushhead portion, wherein at least others of the depending legs are configured to removably latch onto a portion of the outer brushhead portion, providing a joining relationship therebetween, but permitting oscillation of the inner brushhead portion relative to the outer brushhead portion, wherein the inner brushhead portion and the outer brushhead portion are configured relative to each other and to the hub member such that attaching the outer brushhead portion to the appliance body by means of said connecting structure results in both connection of the outer brushhead portion to the appliance body and connection of the inner brushhead portion to the hub member.

2. The attachment system of claim 1, wherein the first and second cleaning members are bristles.

3. The attachment system of claim 1, wherein the first and second cleaning members are foam.

4. The attachment system of claim 1, wherein at least some of the depending legs are configured to latch onto a portion of the hub member.

5. The attachment system of claim 1, wherein the outer brushhead portion is in the form of an annular ring and the inner brushhead portion is circular, fitting within the outer brushhead portion, and wherein the cleaning members on the outer and inner brushhead portions are in the same plane when the brushhead assembly portions are in place on the appliance.

6. The attachment system of claim 1, wherein the outer brushhead portion is in the form of an annular ring and the inner brushhead portion is circular, fitting within the outer brushhead portion, and wherein the cleaning members on the outer and inner brushhead portions are in different but parallel planes when the brushhead portions are in place on the appliance.

7. The attachment system of claim 1, wherein the appliance body includes a plurality of extending pins, and wherein the connecting structure in the outer brushhead portion includes a plurality of matching grooves therein for mating with the extending pins to secure the outer brushhead portion to the appliance body.

8. The attachment system of claim 7, wherein the grooves are arranged and configured to provide a small over-travel characteristic for the outer brushhead portion as the outer brushhead portion is installed by rotation of the outer brushhead portion, the grooves being further configured to permit a slight outward movement of the outer brushhead portion under spring action when the outer brushhead portion is released.

9. The attachment system of claim 7, wherein the grooves are arranged and configured to aid in removal of the outer brushhead portion which in turn results in removal of the inner brushhead portion from its operative relationship with the hub member.

10. The attachment system of claim 1, wherein the depending legs of the inner brushhead portion includes a first set of spaced legs, each comprising split portions which can flex toward each other slightly, and which include latching elements on an outside surface thereof for latching onto a portion of the inner surface of the outer brushhead portion to temporarily secure the outer and inner brushhead portions longitudinally together while permitting rotational movement of the inner brushhead portion, wherein the latching portions are configured so that the inner brushhead portion can be inserted onto and removed from the outer brushhead portion by a user.

11. The attachment system of claim 10, wherein the depending legs include a second set of spaced legs alternating with said first set of legs, wherein the second set of legs mates with matching projections on the hub member in an interference fit to provide for rotational action thereof.

12. The attachment system of claim 11, wherein the locking elements on the hub member comprise a plurality of diamond-shaped spaced projections on the exterior surface of the hub member and are configured to provide an interference fit with the second set of spaced legs, and are further configured to provide a snap-type connection with the first set of spaced legs.

13. The attachment system of claim 12, wherein the exterior surface of the hub member on which the projections are mounted is slightly outwardly tapered so as to force the depending legs outwardly, increasing a secure fit between the depending legs and the hub member.

14. The attachment system of claim 1, wherein the outer brushhead portion includes finger grips spaced around an upper periphery thereof to aid a user in installation of the brushhead assembly onto the appliance.

15. The attachment system of claim 1, including openings in the hub member to permit additional air to reach the cleaning member in the brushhead assembly.

* * * * *